US010082344B2

(12) United States Patent
Tanda et al.

(10) Patent No.: US 10,082,344 B2
(45) Date of Patent: Sep. 25, 2018

(54) FIN-AND-TUBE HEAT EXCHANGER AND REFRIGERATION CYCLE APPARATUS INCLUDING THE SAME

(71) Applicant: Mitsubishi Electric Corporation, Tokyo (JP)

(72) Inventors: Tsubasa Tanda, Tokyo (JP); Akira Ishibashi, Tokyo (JP); Shin Nakamura, Tokyo (JP); Satoshi Ueyama, Tokyo (JP); Aya Kawashima, Tokyo (JP)

(73) Assignee: Mitsubishi Electric Coporation, Tokyo (JP)

( * ) Notice: Subject to any disclaimer, the term of this patent is extended or adjusted under 35 U.S.C. 154(b) by 0 days.

(21) Appl. No.: 15/528,816

(22) PCT Filed: Mar. 2, 2015

(86) PCT No.: PCT/JP2015/056116
§ 371 (c)(1),
(2) Date: May 23, 2017

(87) PCT Pub. No.: WO2016/139730
PCT Pub. Date: Sep. 9, 2016

(65) Prior Publication Data

US 2017/0307305 A1 Oct. 26, 2017

(51) Int. Cl.
*F28F 1/32* (2006.01)
*F25B 39/00* (2006.01)
(Continued)

(52) U.S. Cl.
CPC ..... *F28F 1/325* (2013.01); *F25B 39/00* (2013.01); *F28D 1/05383* (2013.01);
(Continued)

(58) Field of Classification Search
CPC .... F28D 1/0473; F28D 1/0476; F28D 1/0478; F28D 1/0535; F28F 1/32; F25D 21/14
(Continued)

(56) References Cited

U.S. PATENT DOCUMENTS 2,656,808 A * 10/1953 Plumeri et al. ..... B21C 37/24 165/181
4,300,629 A * 11/1981 Hatada et al. ..... F28F 1/325 165/151
(Continued)

FOREIGN PATENT DOCUMENTS

JP 05-034470 U 5/1993
JP 2007-183088 7/2007
(Continued)

OTHER PUBLICATIONS

Extended European Search Report dated Feb. 3, 2017 for the corresponding EP application No. 15868658.4.
(Continued)

*Primary Examiner* — Allen Flanigan
(74) *Attorney, Agent, or Firm* — Posz Law Group, PLC

(57) ABSTRACT

Provided are rectangular plate-like fins 2 layered at intervals; and flat tubes 3 which are perpendicularly extended through the layered plate-like fins 2 and are provided on multiple levels along a longitudinal direction of the plate-like fins 2. The plate-like fins 2 are provided with at least one heat transfer promoting section 6 that is positioned in a region between adjacently-positioned flat tubes 3 and in which ridge sections 4 and valley sections 5 having ridge-lines extending in the longitudinal direction of the plate-like fins 2 are arranged to alternate. En the heat transfer promoting section 6, at least one slit 7 allowing communication between a front and a back of the plate-like fin 2 is formed on a downwind side of the ridge sections 4.

6 Claims, 3 Drawing Sheets

(51) Int. Cl.
*F28D 1/053* (2006.01)
*F25B 39/02* (2006.01)

(52) U.S. Cl.
CPC ..... *F25B 39/02* (2013.01); *F28F 2215/08* (2013.01); *F28F 2215/10* (2013.01); *F28F 2215/12* (2013.01)

(58) Field of Classification Search
USPC ..... 165/151, 182; 62/291
See application file for complete search history.

(56) References Cited

U.S. PATENT DOCUMENTS 5,582,246 A * 12/1996 Dinh ..... B21D 53/02 165/151
2011/0030932 A1* 2/2011 Tucker et al. ..... B21D 53/08 165/151
2012/0103583 A1* 5/2012 Kim et al. ..... F28D 1/05391 165/173
2013/0284416 A1 10/2013 Jindou et al.
2015/0075213 A1* 3/2015 Ishibashi et al. ..... F28F 1/32 62/498

FOREIGN PATENT DOCUMENTS

JP 2012-163318 A 8/2012
JP 2014-035122 A 2/2014
JP 2014-224638 12/2014

OTHER PUBLICATIONS

International Search Report of the International Searching Authority dated May 19, 2015 for the corresponding International application No. PCT/JP2015/056116 (and English translation).

* cited by examiner

FIN-AND-TUBE HEAT EXCHANGER AND REFRIGERATION CYCLE APPARATUS INCLUDING THE SAME

CROSS REFERENCE TO RELATED APPLICATION

This application is a U.S. national stage application of PCT/JP2015/056116 filed on Mar. 2, 2015, the contents of which are incorporated herein by reference.

TECHNICAL FIELD

The present invention relates to a fin-and-tube heat exchanger employing flat tubes, in particular, to a fin-and-tube heat exchanger capable of discharging condensation water in an improved manner without losing tolerance against frost, and a refrigeration cycle apparatus including the same.

BACKGROUND ART

Conventionally, this type of fin-and-tube heat exchanger is configured to promote heat transfer by employing heat transfer tubes each of which has a flat-shaped cross-section (hereinafter, "flat tubes") and providing the surface of a plate-like fin with a heat transfer promoting section in which ridge sections and valley sections are arranged to alternate (see, for example, Patent Literature 1).

Further, another configuration is also known in which slits having openings on the upwind side with respect to the flow of gas are formed in a heat transfer promoting section provided on the surface of a plate-like fin, for the purpose of promoting the discharge of condensation water generated on the surface of the plate-like fin (see, for example, Patent Literature 2).

CITATION LIST

Patent Literature

Patent Literature 1: Japanese Unexamined Patent Application Publication No. 2012-163318 (FIG. 10, FIG. 11)

Patent Literature 2: Japanese Unexamined Patent Application Publication No. 2014-35122 (claim 1, FIG. 2, FIG. 3)

SUMMARY OF INVENTION

Technical Problem

In conventional fin-and-tube heat exchangers, i.e., combinations of flat tubes and plate-like fins, condensation water generated on the surface of the flat tubes and the surface of the plate-like fins stays on the top faces of the flat tubes and the surface of the plate-like fins since the flat tubes each have a flat shape, and in addition, some water is also held on the bottom faces of the flat tubes due to surface tension of the water. Accordingly, a problem arises where the heat exchange efficiency is significantly degraded because thermal resistance between the gas flowing over the surface of the flat tubes and the fluid on the inside of the flat tubes is increased, and draft resistance is also increased.

Further, in a refrigeration cycle apparatus (e.g., an air-conditioning apparatus), an outdoor heat exchanger included in an outdoor unit and serving as an evaporator during a heating operation is easily frosted. Further, when the discharge of condensation water is promoted by using slits having openings on the upwind side with respect to the flow of gas as water guiding paths, frost unevenly forms on the slits due to the leading edge effect of temperature boundary layers. For this reason, another problem arises where the heating capacity is degraded by an increase in the draft resistance.

In this situation, the leading edge effect of a temperature boundary layer is an effect where, when a flat plate is placed in a flow, the boundary layer is thinner at the leading edge of the flat plate (in the present example, the edge of each of the openings of the slits positioned on the upwind side) and the boundary layer becomes thicker toward the downstream of the flow, and thus, the heat transfer rate is higher and the heat transfer is better promoted at the leading edge part of the flat plate (the edge part of each of the openings of the slits positioned on the upwind side).

To solve the problems described above, it is an object of the present invention to obtain a fin-and-tube heat exchanger capable of promoting the discharge of water from the surface of the heat transfer tubes and the plate-like fins without losing tolerance against frost, as well as a refrigeration cycle apparatus including the same.

Solution to Problem

A fin-and-tube heat exchanger according to the present invention includes: rectangular plate-like fins layered at intervals; and flat tubes which are perpendicularly inserted in the layered plate-like fins and are arranged on multiple levels along a longitudinal direction of the plate-like fins. The plate-like fins are provided with at least one heat transfer promoting section that is positioned in a region between adjacently-positioned flat tubes and in which ridge sections and valley sections having ridgelines extending in the longitudinal direction of the plate-like fins are arranged to alternate. In the heat transfer promoting section, at least one slit allowing communication between a front and a back of the plate-like fin is formed on a downwind side of the ridge sections.

A refrigeration cycle apparatus according to the present invention includes: at least a compressor, a condenser, an expansion unit, and an evaporator that are connected together in a loop formation by refrigerant pipes to structure a refrigerant circuit, and the refrigerant circuit is filled with refrigerant. The fin-and-tube heat exchanger described above is used as the evaporator.

Advantageous Effects of Invention

In the fin-and-tube heat exchanger according to the present invention, at least one slit allowing communication between the front and the back of the plate-like fin is formed on the downwind side of the ridge sections in the heat transfer promoting section of the plate-like fin. Accordingly, condensation water generated on the bottom face of the flat tube and in the vicinity of the slit of the plate-like fin is guided downward along the slit due to the capillary phenomenon of the slit, and the discharge of the water is thus promoted. Consequently, the draft resistance is prevented from increasing, and the heat transfer capability is therefore improved.

Further, the slit formed on the downwind side of the ridge sections in the heat transfer promoting section of the plate-like fin is not much exposed to wind, and the mixing and agitating of the air flow is thus inhibited. For this reason, the draft resistance is prevented from increasing. Consequently, the leading edge effect of the temperature boundary layer of the slit is inhibited. It is therefore possible to prevent frost from forming unevenly at the edge section on the upwind side of the slit.

Further, in the refrigeration cycle apparatus according to the present invention, since the aforementioned fin-and-tube heat exchanger is used as an evaporator, it is possible to prevent frost from forming unevenly.

DESCRIPTION OF EMBODIMENTS

Embodiment 1

Figure 1:
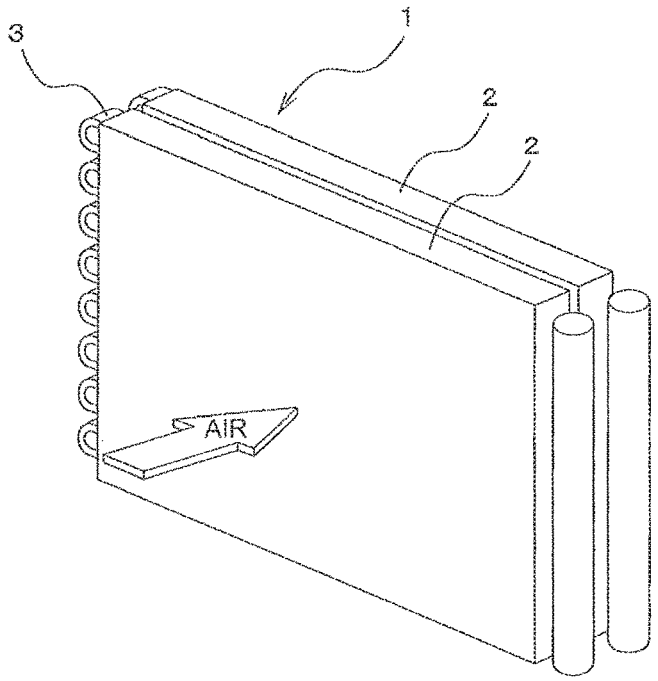
FIG. 1 is a perspective view of a fin-and-tube heat exchanger according to Embodiment 1 of the present invention.
Figure 2:
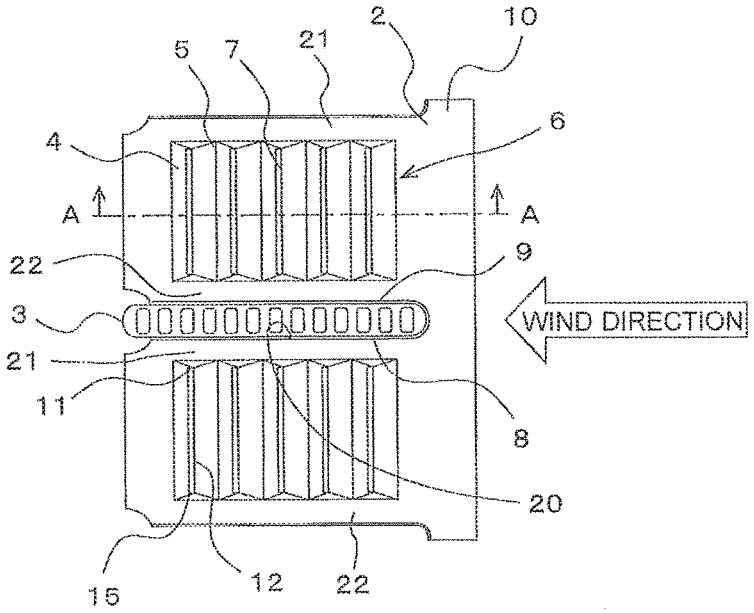
FIG. 2 is a plan view of a flat-tube penetrating section of a plate-like fin employed in the fin-and-tube heat exchanger illustrated in FIG. 1.
Figure 3:
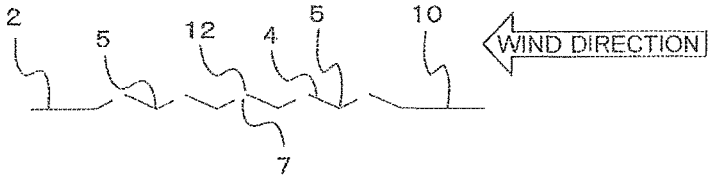
FIG. 3 is a cross-sectional view taken in the direction of the arrows along the line A-A in FIG. 2.

FIG. 1 is a perspective view of a fin-and-tube heat exchanger according to Embodiment 1 of the present invention. FIG. 2 is a plan view of a flat-tube penetrating section of a plate-like fin employed in the fin-and-tube heat exchanger illustrated in FIG. 1. FIG. 3 is a cross-sectional view taken in the direction of the arrows along the line A-A in FIG. 2.

As illustrated in FIGS. 1 to 3, the fin-and-tube heat exchanger (hereinafter, simply "heat exchanger") according to Embodiment 1 includes: a plurality of rectangular plate-like fins 2 arranged in parallel to one another in large quantity so that gas flows through the spaces formed therebetween; and heat transfer tubes (hereinafter, "flat tubes") 3 each of which has a flat-shaped cross-section, each of which is perpendicularly inserted in a cut-out section 20 formed in a corresponding one of the plate-like fins 2, are arranged on multiple levels along the longitudinal direction (i.e., the direction of the levels) of the plate-like fins 2, and are each configured to allow an operating fluid to pass therethrough.

The plate-like fins 2 have at least one heat transfer promoting section 6. The heat transfer promoting section 6 includes: a plurality of ridge sections 4 arranged in a row in such a manner that the ridgelines thereof extend in the longitudinal direction of the plate-like fins 2, i.e., in the direction extending along the surface of the fins and being orthogonal to the wind direction; and a plurality of valley sections 5 formed between the ridge sections 4. The ridge sections 4 and the valley sections 5 are arranged to alternate along the wind direction and to form a corrugated shape. Further, the heat transfer promoting section 6 has formed therein, on the downwind side of the ridge sections 4, slits 7 allowing communication between the front and the back of the plate-like fin 2. The ridge sections 4 and the valley sections 5 may be formed by performing a drawing process, for example. In FIG. 2, the reference numeral 8 denotes the bottom face of the flat tube 3, the reference numeral 9 denotes the top face of the flat tube 3, the reference numeral 10 denotes a leading edge section of the plate-like fin 2, the reference numeral 11 denotes an upper end section of the slit 7, the reference numeral 12 denotes an end section of the slit 7 positioned on the upwind side, and the reference numeral 15 denotes a lower end section of the slit 7.

Figure 7:
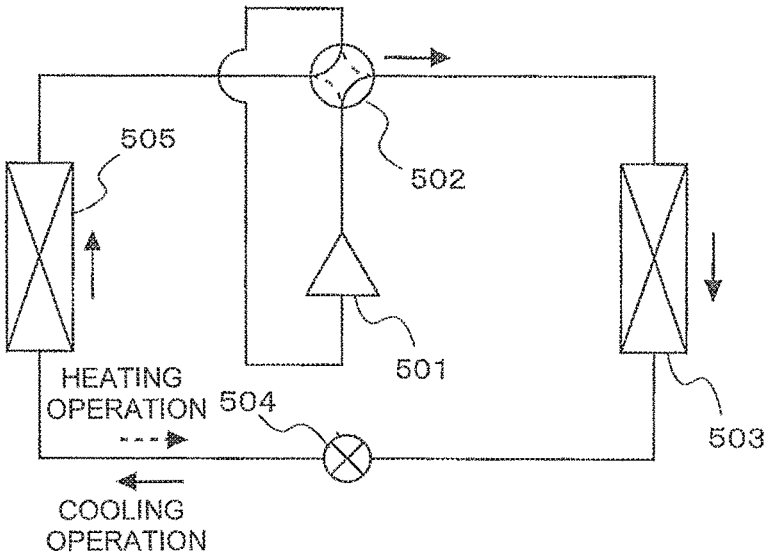
FIG. 7 is a refrigerant circuit diagram of an air-conditioning apparatus that represents an example of the refrigeration cycle apparatuses according to Embodiments 1 and 2 of the present invention.

Next, an example of a refrigeration cycle apparatus including the fin-and-tube heat exchanger configured as described above will be explained. FIG. 7 is a refrigerant circuit diagram of an air-conditioning apparatus that represents an example of the refrigeration cycle apparatus according to Embodiment 1 of the present invention.

As illustrated in FIG. 7, the air-conditioning apparatus includes a refrigerant circuit in which a compressor 501, a four-way valve 502, an outdoor side heat exchanger 503 installed in an outdoor unit, an expansion valve 504 serving as an expansion unit, and an indoor side heat exchanger 505 installed in an indoor unit are sequentially connected together by pipes to allow refrigerant to circulate therein.

The four-way valve 502 switches between a heating operation and a cooling operation by switching the direction in which the refrigerant flows within the refrigerant circuit. When the air-conditioning apparatus is configured as a cooling-only or heating-only air-conditioning apparatus, the four-way valve 502 may be omitted.

The outdoor side heat exchanger 503 corresponds to the heat exchanger 1, which is the aforementioned fin-and-tube heat exchanger. The outdoor side heat exchanger 503 functions as a condenser to heat gas (outdoor air) with the heat of the refrigerant during the cooling operation and functions as an evaporator to evaporate the refrigerant and to cool gas (outdoor air) with the heat of evaporation of the evaporated refrigerant during the heating operation.

The compressor 501 compresses and raises the temperature of the refrigerant discharged from the evaporator and supplies the compressed and heated refrigerant to the condenser, The expansion valve 504 expands and lowers the temperature of the refrigerant discharged from the condenser and supplies the expanded and cooled refrigerant to the evaporator, Next, an operation of the heat exchanger 1 according to Embodiment 1 will be explained with reference to FIGS. 1 to 3 and FIG. 7.

In the heat exchanger 1 configured as described above, when the heat exchanger 1 is used as a cooling device (the evaporator) for the gas (the outdoor air), the condensation water generated on the plate-like fins 2 and the bottom face 8 of the flat tube 3 is guided downward along the slits 7, due to the capillary phenomenon of the slits 7 formed on the downwind side of the ridge sections 4 in the heat transfer promoting section 6.

Further, since the slits 7 are formed in such a manner that communication is allowed between the front and the back of the plate-like fin 2, when condensation water flows down along the slits 7, some condensation water adhering to the front and the back of the plate-like fin 2 gathers together via the slits 7 and promotes the downward flow caused by the gravity, The condensation water that has flowed down along the slits 7 stays on the top face 9 of the flat tube 3 for a while, and when a certain amount of condensation water has accumulated, the condensation water flows down along the leading edge sections 10 of the plate-like fin 2. Also, part of the condensation water stays on the bottom face 8 of the flat tube 3 due to surface tension. Some condensation water that has shifted around to the bottom face 8 of the flat tube 3 is guided by the slits 7 formed on the ridge sections 4 in the heat transfer promoting section 6 of the plate-like fin 2.

The slits 7 formed in the heat transfer promoting section are positioned on the downwind side, with respect to the gas passing direction, relative to the ridgelines of the ridge sections 4 of the heat transfer promoting section 6. The slits 7 are therefore less exposed to the wind, and the mixing and agitating of the air flow is thus inhibited. For this reason, the draft resistance is prevented from increasing. Consequently, in the outdoor side heat exchanger 503 (i.e., the heat exchanger 1) provided in the outdoor unit, which is easily frosted while the air-conditioning apparatus is performing the heating operation, the leading edge effect of the temperature boundary layers of the slits 7 is inhibited. It is therefore possible to prevent frost from forming unevenly at the end sections 12 positioned on the upwind side of the slits 7.

It is possible to achieve an even better water-discharge promoting effect, when the distance between the bottom face 8 of the flat tube 3 and the upper end sections 11 of the slits 7 is shorter; however, the positions of the slits 7 are not particularly limited. When the lower end sections 15 of the slits 7 are positioned too close to the top face 9 of the flat tube 3, condensation water is sucked up by the slits 7 due to the capillary phenomenon, and the water discharging process may be hindered. For this reason, it is desirable to arrange the distance between the lower end sections 15 of the slits 7 and the top face 9 of the flat tube 3 to be such that, even when some condensation water stays on the top face 9 of the flat tube 3, the condensation water is able to start flowing without being sucked up by the slits 7. Further, if the distance between the bottom face 8 of the flat tube 3 and the upper end sections 11 of the slits 7 and the distance between the lower end sections 15 of the slits 7 and the top face 9 of the flat tube 3 were too short, it would be difficult to process the cut-out section 20 and the heat transfer promoting section 6. For this reason, the heat exchanger 1 according to Embodiment 1 is configured in such a manner that unprocessed sections 21 and 22 are provided between the bottom face 8 of the flat tube 3 and the upper end sections 11 of the slits 7 and between the lower end sections 15 of the slits 7 and the top face 9 of the flat tube 3. With this arrangement, even when some condensation water is staying on the top face 9 of the flat tube 3, it is possible to prevent the condensation water from being sucked up by the slits 7, and it is also possible to secure processability of the heat transfer promoting section 6.

As explained above, the heat exchanger 1 according to Embodiment 1 is configured in such a manner that the slits 7 are formed on the downwind side of the ridge sections 4 in the heat transfer promoting section 6 of the plate-like fin 2, the slits 7 each serving as the water discharging path and allowing communication between the front and the back of the plate-like fin 2. It is therefore possible to smoothly discharge the condensation water and to thus enhance the heat transfer capability. In addition, by arranging a refrigeration cycle apparatus (e.g., an outdoor unit of an air-conditioning apparatus) to include the heat exchanger 1, it is possible to prevent frost from forming unevenly during a heating operation. It is therefore possible to inhibit the degradation of the heating capacity.

In Embodiment 1 described above, the discharging of the water is promoted only by using the slits 7 formed in the plate-like fins 2. It is, however, possible to achieve an even better water discharging effect by configuring a heat exchanger to further have folded sections 13 on the plate-like fins 2 for the purpose of securing a fin pitch. An example of this configuration will be explained in Embodiment 2 below.

Embodiment 2

Figure 4:
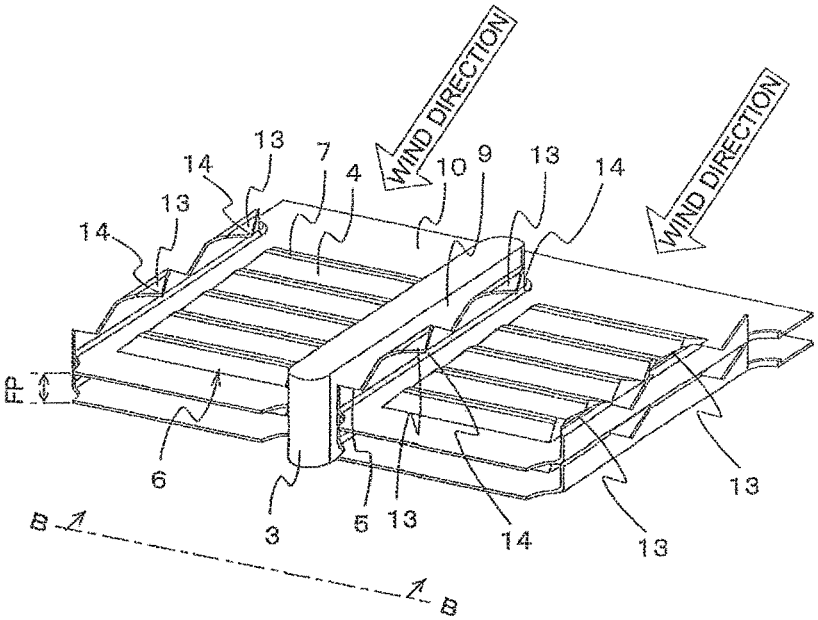
FIG. 4 is a perspective view of a flat-tube penetrating section of a plate-like fin employed in a fin-and-tube heat exchanger according to Embodiment 2 of the present invention.
Figure 5:
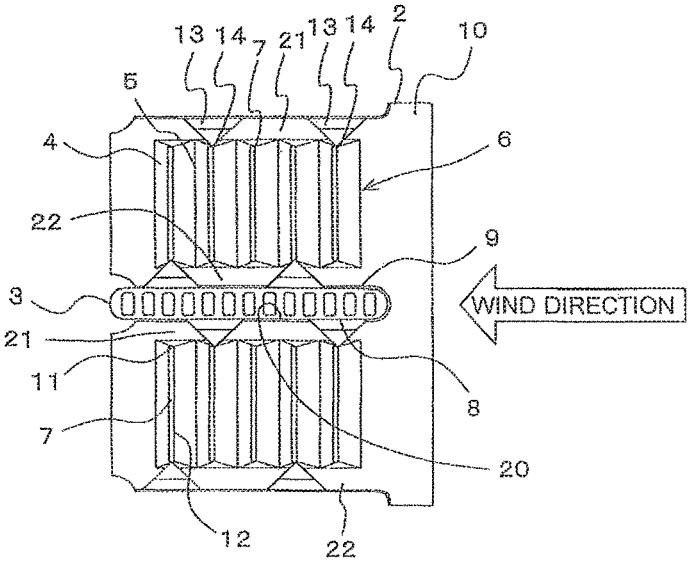
FIG. 5 is a plan view of the flat-tube penetrating section of the plate-like fin employed in the fin-and-tube heat exchanger according to Embodiment 2 of the present invention.
Figure 6:
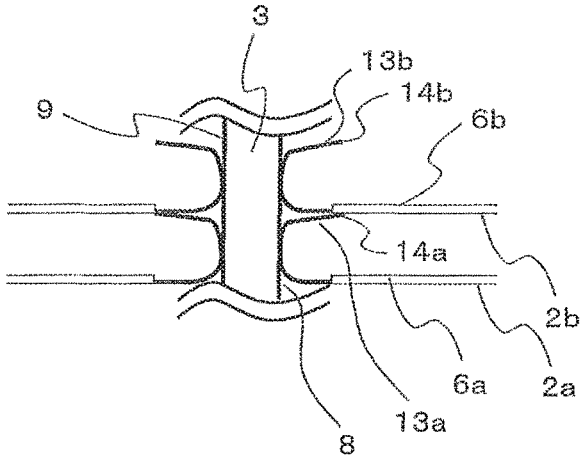
FIG. 6 is a side view of the flat-tube penetrating section of the plate-like fin taken in the direction of the line B-B in FIG. 4.

FIG. 4 is a perspective view of a flat-tube penetrating section of a plate-like fin employed in a fin-and-tube heat exchanger according to Embodiment 2 of the present invention. FIG. 5 is a plan view of the flat-tube penetrating section of the plate-like fin employed in the fin-and-tube heat exchanger according to Embodiment 2 of the present invention. FIG. 6 is a side view of the flat-tube penetrating section of the plate-like fin taken in the direction of the line B-B in FIG. 4. In the drawings, some of the elements corresponding to those in Embodiment 1 are referred to by using the same reference characters. Also, FIG. 1 will be referenced in the following explanations.

In a fin-and-tube heat exchanger (i.e., the heat exchanger 1) according to Embodiment 2 of the present invention, as illustrated in FIGS. 4 to 6, the plate-like fin 2 has formed thereon folded sections 13 each having a sharp-angled tip end (e.g., having a triangular shape), for the purpose of securing a fin pitch (FP), which is the space formed between any two of the plate-like fins 2 positioned adjacent to each other. The folded sections 13 are positioned in such a manner that the position of at least one of the tip ends 14 of the triangles is aligned with the position of at least one of the slits 7 in the heat transfer promoting section 6 of the adjacently-positioned plate-like fin 2.

More specifically, each of the folded sections 13 is structured with a folded piece extending from the unprocessed section 21 (or 22) provided between the ridge and valley sections 4, 5 of the plate-like fin 2 and the flat tube 3 arranged above (or below) the ridge and valley sections 4, 5. While being layered, the plate-like fins 2 are able to keep the predetermined interval therebetween, since folded sections 13*a* and 13*b* abut against adjacently-positioned plate-like fins 2*a* and 2*b*, respectively. The position of a tip end 14*a* of the folded section 13*a* of a heat transfer promoting section 6*a* of the plate-like fin 2*a* positioned at the bottom face 8 of the flat tube 3 is aligned with the position of at least one of the slits 7 in a heat transfer promoting section 6*b* of the adjacently-positioned plate-like fin 2*b*. The same applies to the position of a tip end 14*b* of the folded section 13*b* of the plate-like fin 2*b*. The other configurations are the same as those of the heat exchanger 1 according to Embodiment 1 described above, and the explanation thereof will be omitted.

Next, an operation of the heat exchanger 1 according to Embodiment 2 will be explained, with reference to FIGS. 4 to 6 and FIG. 7, Also in the heat exchanger 1 configured as described above, when the heat exchanger 1 is used as a cooling device (the evaporator) for the gas (the outdoor air), the condensation water generated on the plate-like fins 2 and the bottom face 8 of the flat tube 3 is guided downward along the slits 7, due to the capillary phenomenon of the slits 7 formed on the downwind side of the ridge sections 4 in the heat transfer promoting section 6.

Further, also in the heat exchanger 1 according to Embodiment 2, since the slits 7 are formed in such a manner that communication is allowed between the front and the back of the plate-like fin 2, when condensation water flows down along the slits 7, some condensation water adhering to the front and the back of the plate-like fin 2 gathers together via the slits 7 and promotes the downward flow caused by the gravity.

Further, also in the heat exchanger 1 according to Embodiment 2, the condensation water that has flowed down along the slits 7 stays on the top face 9 of the flat tube 3 for a while, and when a certain amount of condensation water has accumulated, the condensation water flows down along the leading edge sections 10 of the plate-like fin 2. Also, part of the condensation water stays on the bottom face 8 of the flat tube 3 due to surface tension. Some condensation water that has shifted around to the bottom face 8 of the flat tube 3 is guided by the slits 7 formed on the ridge sections 4 in the heat transfer promoting section 6 of the plate-like fin 2.

Also in the heat exchanger 1 according to Embodiment 2, it is possible to achieve an even better water-discharge promoting effect, when the distance between the bottom face 8 of the flat tube 3 and the upper end sections 11 of the slits 7 is shorter; however, the positions of the slits 7 are not particularly limited. When the lower end sections 15 of the slits 7 are positioned too close to the top face 9 of the flat tube 3, condensation water is sucked up by the slits 7 due to the capillary phenomenon, and the water discharging process may be hindered. For this reason, it is desirable to arrange the distance between the lower end sections 15 of the slits 7 and the top face 9 of the flat tube 3 to be such that, even when some condensation water stays on the top face 9 of the flat tube 3, the condensation water is able to start flowing without being sucked up by the slits 7.

Further, also in the heat exchanger 1 according to Embodiment 2, the slits 7 formed in the heat transfer promoting section are positioned on the downwind side, with respect to the gas passing direction, relative to the ridgelines of the ridge sections 4 of the heat transfer promoting section 6. The slits 7 are therefore less exposed to the wind, and the mixing and agitating of the air flow is thus inhibited. For this reason, the draft resistance is prevented from increasing. Consequently, in the outdoor side heat exchanger 503 (i.e., the heat exchanger 1) provided in the outdoor unit, which is easily frosted while the air-conditioning apparatus is performing the heating operation, the leading edge effect of the temperature boundary layers of the slits 7 is inhibited. It is therefore possible to prevent frost from forming unevenly at the end sections 12 positioned on the upwind side of the slits 7.

In particular, in the heat exchanger 1 according to Embodiment 2, the position of the tip end 14*a* of the triangular folded section 13*a* of the plate-like fin 2*a* positioned at the bottom face 8 of the flat tube 3 is arranged to be aligned with the position of one of the slits 7 in the heat transfer promoting section 6 of the adjacently-positioned plate-like fin 2*b*. Accordingly, condensation water staying on the bottom face 8 of the flat tube 3 is guided to the slit 7 in the heat transfer promoting section 6*b* of the adjacently-positioned plate-like fin 2*b*, via the folded section 13*a* and the tip end 14*a* of the plate-like fin 2*a*. To achieve the water-discharge promoting effect, there is no need to arrange the positions of the tip ends 14*a* of the folded sections of the plate-like fin 2*a* positioned at the bottom face 8 of the flat tube 3 to necessarily be aligned with the positions of the slits 7 in the heat transfer promoting section 6*a* of the adjacently-positioned plate-like fin 2*b*. It is sufficient when the position of at least one of the tip ends 14*a* of the plate-like fin 2*a* is aligned with the position of at least one of the slits 7 of the plate-like fin 2*b*.

As explained above, the heat exchanger 1 according to Embodiment 2 is configured in such a manner that the slits 7 each serving as the water discharging path are formed in the plate-like fin 2. It is therefore possible to smoothly discharge the condensation water and to thus enhance the heat transfer capability. In addition, by arranging a refrigeration cycle apparatus (e.g., an outdoor unit of an air-conditioning apparatus) to include the heat exchanger 1, it is possible to prevent frost from forming unevenly during a heating operation. It is therefore possible to inhibit the degradation of the heating capacity. Furthermore, by using the folded sections 13 of the plate-like fins 2 as water guiding paths, it is possible to achieve a higher water-discharging capability and to enhance the heat transfer capability.

REFERENCE SIGNS LIST

1 heat exchanger (fin-and-tube heat exchanger) 2, 2*a*, 2*b* plate-like fin flat tube (heat transfer tube) 4 ridge section 5 valley section 6, 6*a*, 6*b* heat transfer promoting section 7 slit 8 bottom face 9 top face 10 leading edge section 11 upper end section 12 end section on upwind side 13, 13*a*, 13*b* folded section 14, 14*a*, 14*b* tip end 15 lower end section 20 cut-out section 21, 22 unprocessed section 501 compressor 502 four-way valve 503 outdoor side heat exchanger 504 expansion valve 505 indoor side heat exchanger

The invention claimed is:

1. A fin-and-tube heat exchanger comprising:

plate-like fins having a rectangular shape and layered at intervals from one another; and flat tubes, wherein the flat tubes extend perpendicularly through the layered plate-like fins, the flat tubes are arranged on multiple levels along a longitudinal direction of the plate-like fins, the plate-like fins are provided with at least one heat transfer promoting section that is positioned in a region between adjacently-positioned flat tubes and in which ridge sections and valley sections, which have ridgelines extending in the longitudinal direction of the plate-like fins, are alternately arranged, each plate-like fin is provided with at least one folded section for securing a fin pitch, which is a space formed between the adjacently-positioned plate-like fins, at least one slit is formed in the heat transfer promoting section on a downwind side of a corresponding one of the ridge sections, and wherein the at least one slit allows communication between a front and a back of a corresponding one of the plate-like fins, the folded section has a sharp-angled tip end and is positioned in such a manner that the sharp-angled tip end is aligned with a single slit of the at least one slit, wherein the single slit is formed in the heat transfer promoting section of an adjacently-positioned one of the plate-like fins, and a side surface of the sharp-angled tip end faces toward and abuts against an adjacent one of the plate-like fins to determine the fin pitch.

2. The fin-and-tube heat exchanger of claim 1, wherein an unprocessed section is provided between the ridge section and the valley section in the heat transfer promoting section of any of the plate-like fins and an adjacently-positioned flat tube.

3. A refrigeration cycle apparatus comprising:

at least a compressor, a condenser, an expansion unit, and an evaporator that are connected together in a loop formation by refrigerant pipes to structure a refrigerant circuit, and the refrigerant circuit is charged with refrigerant, wherein the fin-and-tube heat exchanger of claim 1 is used as the evaporator.

4. A fin-and-tube heat exchanger comprising:

plate-like fins having a rectangular shape and layered at intervals from one another; and flat tubes, wherein the flat tubes extend perpendicularly through the layered plate-like fins, the flat tubes are arranged on multiple levels along a longitudinal direction of the plate-like fins, the plate-like fins are provided with at least one heat transfer promoting section that is positioned in a region between adjacently-positioned flat tubes and in which ridge sections and valley sections, which have ridgelines extending in the longitudinal direction of the plate-like fins, are alternately arranged, each plate-like fin is provided with at least one folded section for securing a fin pitch, which is a space formed between the adjacently-positioned plate-like fins, in each plate-like fin, slits are formed in the heat transfer promoting section on a downwind side of corresponding ones of the ridge sections, and the slits allow communication between a front and a back of each of the plate-like fins, the folded section has a sharp-angled tip end and is positioned in such a manner that the sharp-angled tip end is aligned with one of the slits, wherein the one of the slits is formed in the heat transfer promoting section of an adjacently-positioned one of the plate-like fins, and a side surface of the sharp-angled tip end faces toward and abuts against an adjacent one of the plate-like fins to determine the fin pitch.

5. The fin-and-tube heat exchanger of claim 1, wherein an unprocessed section is provided between the ridge section and the valley section in the heat transfer promoting section of any of the plate-like fins and an adjacently-positioned flat tube.

6. A refrigeration cycle apparatus comprising:

at least a compressor, a condenser, an expansion unit, and an evaporator that are connected together in a loop formation by refrigerant pipes to structure a refrigerant circuit, and the refrigerant circuit is charged with refrigerant, wherein the fin-and-tube heat exchanger of claim 4 is used as the evaporator.

* * * * *